US008001735B2

(12) United States Patent
Fisher

(10) Patent No.: US 8,001,735 B2
(45) Date of Patent: Aug. 23, 2011

(54) FLOOD BARRIER SYSTEM

(75) Inventor: Wayne Fisher, Amenia, NY (US)

(73) Assignee: The Presray Corporation, Pawling, NY (US)

( * ) Notice: Subject to any disclaimer, the term of this patent is extended or adjusted under 35 U.S.C. 154(b) by 21 days.

(21) Appl. No.: 12/061,329

(22) Filed: Apr. 2, 2008

(65) Prior Publication Data

US 2009/0252557 A1 Oct. 8, 2009

(51) Int. Cl.
*E06B 3/26* (2006.01)

(52) U.S. Cl. ..... 52/202; 52/584.1; 52/169.14; 405/107

(58) Field of Classification Search ..... 52/202, 52/203, 479, 584.1, 169.6, 169.14; 49/61, 49/63, 64; 405/107, 110, 112, 114; 70/19
See application file for complete search history.

(56) References Cited

U.S. PATENT DOCUMENTS

| | | | | |
|---|---|---|---|---|
| 2,579,995 | A | 12/1951 | Atchison | |
| 2,680,886 | A * | 6/1954 | Urban | 52/78 |
| 2,756,469 | A * | 7/1956 | Cattermole et al. | 49/55 |
| 4,128,267 | A * | 12/1978 | Niblett et al. | 294/81.56 |
| 4,221,390 | A * | 9/1980 | Bainbridge | 277/398 |
| 4,377,352 | A * | 3/1983 | Goodstein | 405/115 |
| 4,439,061 | A * | 3/1984 | Whipps | 405/104 |
| 4,650,365 | A * | 3/1987 | Runnels | 404/25 |
| 5,077,945 | A * | 1/1992 | Koeniger | 52/169.14 |
| 5,426,893 | A * | 6/1995 | Hoffman | 49/464 |
| 5,579,615 | A * | 12/1996 | Hoffman | 52/202 |
| 5,943,832 | A * | 8/1999 | Russell | 52/202 |
| 6,029,405 | A * | 2/2000 | Wood | 52/2.23 |
| 6,039,503 | A * | 3/2000 | Cathey | 404/67 |
| 6,079,168 | A * | 6/2000 | Shaver | 52/202 |
| 6,189,264 | B1 * | 2/2001 | DiVeroli | 49/57 |

(Continued)

FOREIGN PATENT DOCUMENTS

DE 20313139 U1 4/2004

(Continued)

OTHER PUBLICATIONS

Presray Critical Containment Solutions "Flood Barriers Flood Gates Watertight Doors & Hatches", pp. 1-8.

(Continued)

*Primary Examiner* — Eileen Lillis
*Assistant Examiner* — James Ference
(74) *Attorney, Agent, or Firm* — St. Onge Steward Johnston & Reens LLC

(57) ABSTRACT

A flood barrier system for temporarily sealing an opening in a wall structure against the inflow of flood waters. The system comprises a plurality of elongated, horizontally disposed barrier elements of a length somewhat greater than the width of the opening. The barrier elements are stacked vertically, one upon the other against the outer face of the wall structure. End clamps engage opposite ends of the individual barrier elements to press them snugly against the outer surface of the wall, providing seals along the opposite vertical side edges of the opening. The barrier elements incorporate a unique interlocking configuration that simplifies and expedites assembly of a flood barrier and strengthens the integrity of the assembled structure. Improved and simplified arrangements are provided for clamping the ends of the barrier elements and for applying downward pressure to the assembled barrier. The resulting structure is more economical to provide and maintain and is more quickly assembled in the often emergency circumstances in which it is required.

4 Claims, 6 Drawing Sheets

U.S. PATENT DOCUMENTS

| | | | | |
|---|---|---|---|---|
| 6,327,819 | B1 * | 12/2001 | Kurose | 49/50 |
| 6,393,782 | B1 | 5/2002 | Berridge et al. | |
| 6,427,396 | B1 * | 8/2002 | Harrison | 52/202 |
| 6,615,555 | B2 * | 9/2003 | Madden | 52/202 |
| 6,623,209 | B1 * | 9/2003 | Waters, Jr. | 405/94 |
| 6,959,519 | B2 * | 11/2005 | Adriaansen | 52/537 |
| 6,974,622 | B2 * | 12/2005 | Wade | 428/182 |
| 7,036,279 | B2 * | 5/2006 | Crozzoli | 52/213 |
| 7,549,252 | B2 * | 6/2009 | Vaughn | 49/466 |
| 2001/0015038 | A1 * | 8/2001 | Cadalso | 52/202 |
| 2002/0104275 | A1 * | 8/2002 | Harrison | 52/202 |
| 2003/0190193 | A1 * | 10/2003 | Waters, Jr. | 405/110 |
| 2004/0045231 | A1 * | 3/2004 | Madden | 52/202 |
| 2005/0210777 | A1 * | 9/2005 | Baughn et al. | 52/202 |

FOREIGN PATENT DOCUMENTS

| | | | |
|---|---|---|---|
| EP | 0163292 | A2 | 12/1985 |
| FR | 2876716 | A1 | 4/2006 |
| GB | 2243393 | A | 10/1991 |
| GB | 2305453 | A * | 4/1997 |
| GB | 2327971 | A * | 2/1999 |
| GB | 2346644 | A * | 8/2000 |
| GB | 2373534 | A * | 9/2002 |
| GB | 2394499 | A * | 4/2004 |

OTHER PUBLICATIONS

International Search Report and Written Opinion of the International Searching Authority; PCT/US2009/037616; May 7, 2009; 7 pages.

* cited by examiner

FLOOD BARRIER SYSTEM

RELATED APPLICATIONS

This application is related to Jason W. Smith U.S. application Ser. No. 11/391,110, filed Mar. 28, 2008, now U.S. Pat. No. 7,552,565, granted Jun. 30, 2009, the disclosure of which is incorporated herein by reference.

BACKGROUND OF INVENTION

In certain areas, homes, offices and commercial and factory buildings occasionally are inundated by flood waters. To minimize damage from rising flood waters, such structures can utilize temporary flood barriers that are installed in low level door and window openings, to seal those openings against inflow of water into the structure. Various barrier systems are available for this purpose, with a wide variety of design features dictated to some extent by the size of the opening to be protected.

For the protection of a relatively wide doorway, for example, against flood waters that may rise to a considerable level above the bottom of the door opening, the barrier system must have considerable structural soundness in order to effectively resist the pressure of water across a wide area and at a relatively high level. One such system that is effective for the purpose has been marketed by Presray Corporation, of Wassaic, N.Y. and consists of a series of horizontally elongated barrier elements (sometimes referred to as "stop logs") which are assembled one atop the other, extending laterally across the full width of the door opening. The individual barrier elements are arranged so that one element is tightly sealed to each vertically adjacent element, and the individual barrier elements are clamped against the front face of the door opening, providing a full perimeter seal and a strong structure to hold back the rising waters.

As can be appreciated, for many locations, flooding is an infrequent event, perhaps an annual experience, or more likely, a situation that occurs only once every few years. Thus, it is typical and customary that the barrier systems are stored away during normal times, and installed only when there is an immediate threat of inundation. However, when flooding circumstances arise, there is much work to do in order to seal all of the openings available in a typical structure, and speed and efficiency of installation can be extremely important because all of the low level openings must be sealed before the structure can be considered protected from inundation. In this respect, water flowing in through a single unprotected opening, even though others are protected, can inundate the entire structure and cause great damage.

The above referenced application of Jason W. Smith represents a substantial improvement in the ability to install stop log type flood barriers efficiently and quickly. The present invention seeks to provide still further improvements in such stop log barriers, to further facilitate rapid installation thereof. The barrier of the present invention also provides an advantageous interlocking feature to add strength to the structure and also to simplify and expedite installation and assembly.

SUMMARY OF THE INVENTION

In the flood barrier of the invention, a plurality of individual stop log barrier elements are stacked one on top of the other, to a predetermined height suitable for the expected flood conditions. The individual barrier elements are clamped against a vertical sealing strip located at opposite sides of the opening to be protected, and each of the barrier elements is provided with a resilient sealing element along its bottom to form a seal with the underlying barrier element or, in the case of the bottom most element, with the threshold of the opening. The entire stack of barrier elements is subjected to downward pressure by vertically acting clamping elements at each side.

In accordance with one aspect of the invention, the individual barrier elements, which may be formed of extruded aluminum sections, are shaped such that each barrier element forms a novel mechanical interlock with the barrier element below. The arrangement allows an upper barrier element to be initially engaged with the element below and then pivoted into an installed position in a simple and highly expeditious manner. This both facilitates the installation process and makes the assembly more stable and secure while the installation is under way.

Pursuant to another aspect of the invention, the new barrier structure incorporates an advantageous form of vertical rail member at each side of the opening to be protected. These rail members are formed with a pair of vertically extending channels, one to receive a vertically extending sealing element, and the other to receive a plurality of slideably positioned clamping assemblies. For each barrier element, a clamping assembly can be slid into a properly aligned position, engaged with a newly installed barrier element, and tightened against the barrier element to maintain it in sealing contact with the vertically extending sealing element. When a flood threat is over, the individual barrier elements are unclamped and removed to a storage location. In addition, the individual clamping assemblies can be removed by sliding them upward and out of the top of the channel that receives them, for storage along with the barrier elements. Thus, during periods when there is no flood threat, the only permanent installation remaining at the protected opening is the presence of the two vertical rail members which are rather unobtrusive and can be decorated or covered to blend with the basic building structure.

The barrier structure of the invention also advantageously incorporates a vertically acting clamping arrangement that is mounted above the uppermost barrier element, at each side thereof, arranged to bear downwardly on the entire stack of barrier elements to assure good sealing pressure between vertically adjacent elements. In the structure of the present invention, such vertically acting clamping mechanisms are slideably installed and removed from the same vertical channels that receive the clamping assemblies. This enables the clamping arrangements to be quickly installed after the last barrier element is in place, and just as quickly removed and remotely stored when the flood threat has terminated.

For a more complete understanding of the above and other features and advantages of the invention, reference should be made to the following detailed description of a preferred embodiment, and to the accompanying drawings.

DESCRIPTION OF A PREFERRED EMBODIMENT

Figure 1:
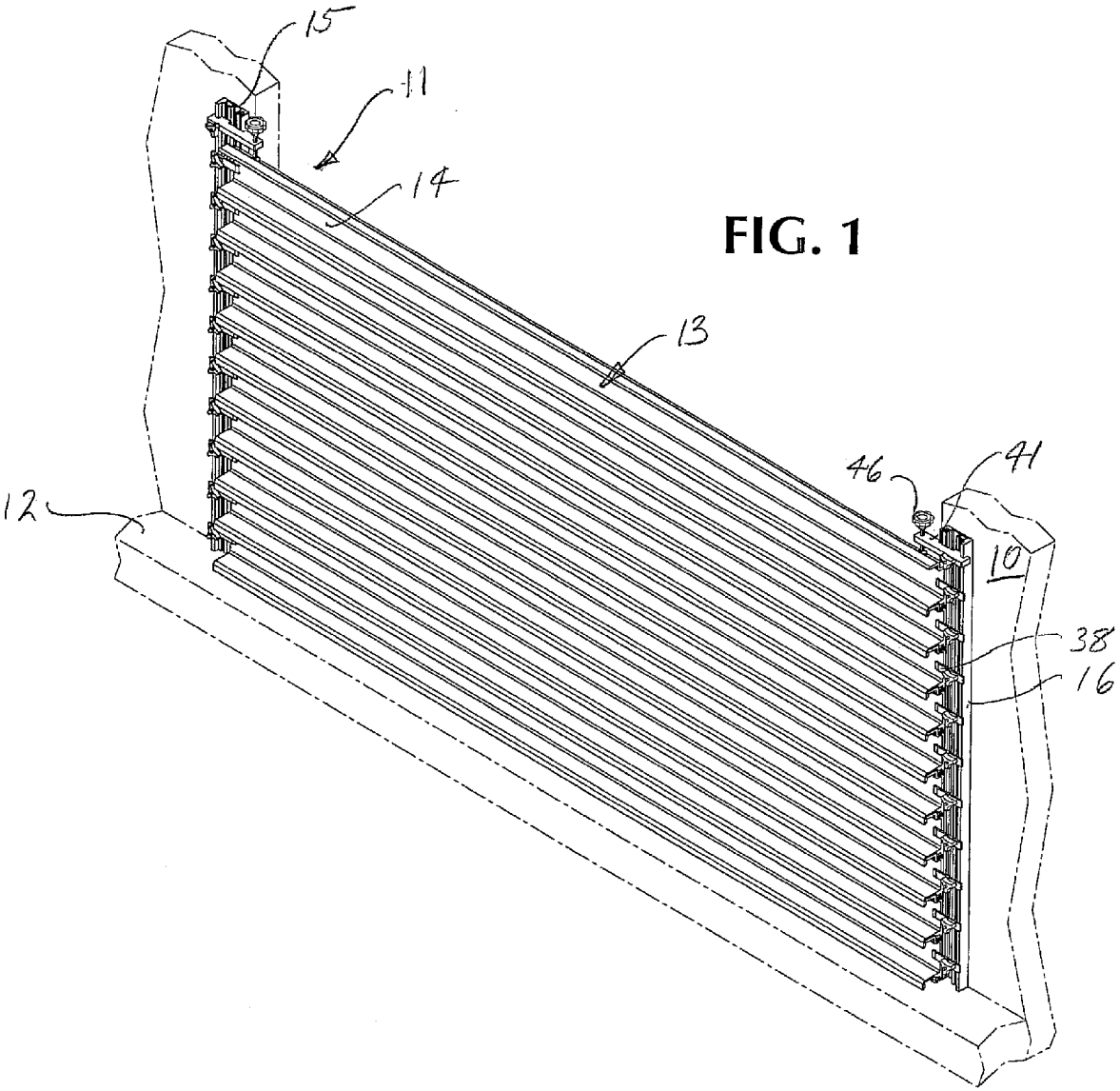
FIG. 1 is a perspective view of a portion of a building or like structure having an opening in which the flood barrier structure of the invention has been installed.
Figure 3:
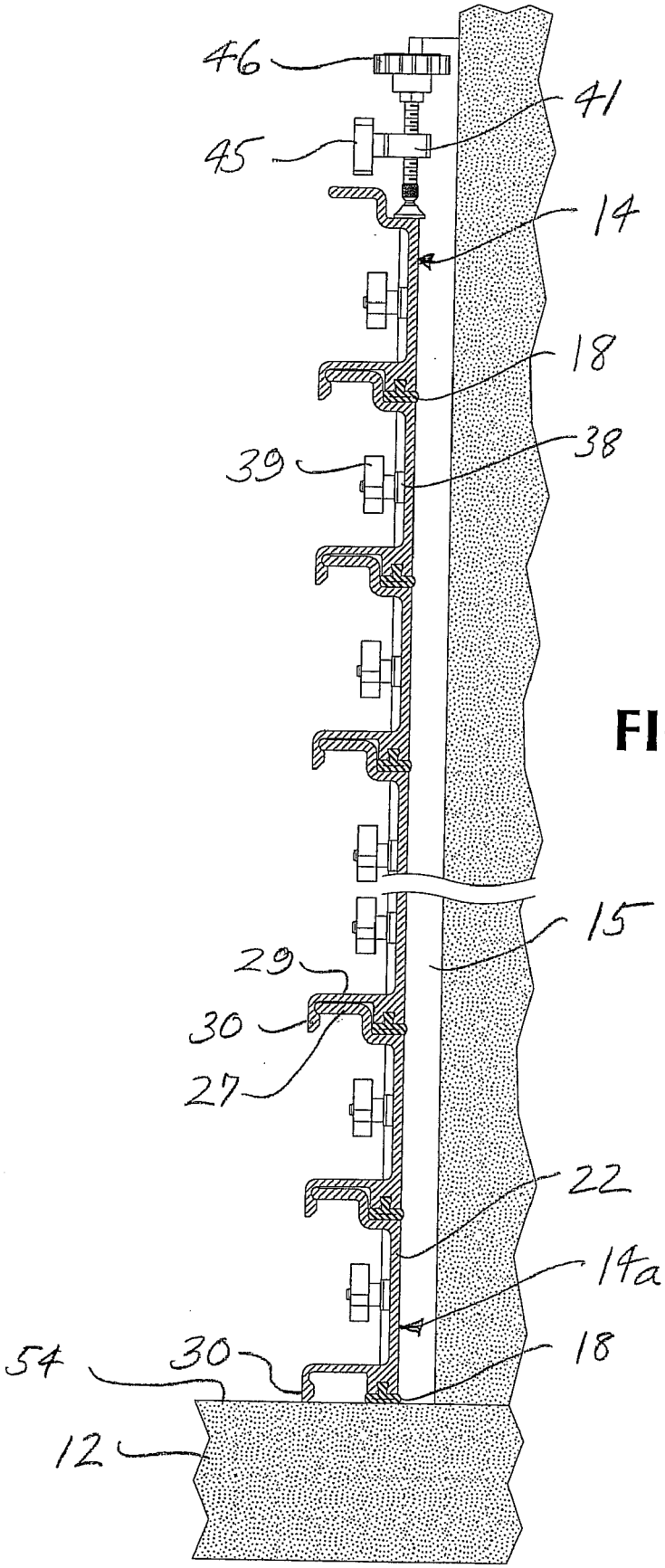
FIG. 3 is a cross sectional view as taken generally on line 3-3 of FIG. 2.

Referring now to the drawings, the reference numeral 10 designates generally a building structure having a large door opening 11 therein which extends upward from a floor or threshold 12. A flood barrier assembly 13 (FIGS. 1 and 3) constructed in accordance with the invention is shown as installed in the doorway 11 to provide a barrier against inundation by flood waters. The barrier is comprised of a plurality of individual, horizontally elongated barrier elements 14, stacked one on top of the other and extending across the full width of the door opening 11. As will become apparent, a flood barrier of any suitable height may be constructed, within the maximum capacity of the installation, by assembling a predetermined number of the barrier elements 14 in a vertical stack.

In the illustrated form of the invention, vertical rails 15, 16 are mounted on the front face of the building structure 10, at each side of the door opening 11. Typically, the rails 15 are permanently attached to the building structure and are bedded with suitable calking or other material to provide a watertight seal between the backs of the rails and the front surface of the building structure.

Figure 7:
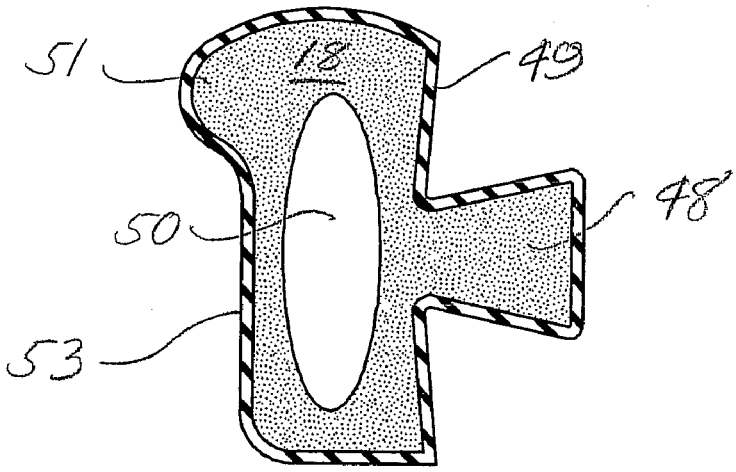
FIG. 7 is an enlarged cross sectional view of a preferred form of sealing element utilized in the flood barrier of the invention.

In the illustrated embodiment, the inside edges of the rails 15, 16 are provided with dovetailed channels 17 for reception of a resilient sealing element, such as illustrated at 18 in FIG. 7. The sealing element extends vertically over the full working height of each of the rails 15, 16 and provides a resilient surface against which back walls 19 of the barrier elements 14 can be pressed to form a continuous seal at the side edges of the structure. Bottom flange portions 20 of the barrier elements are provided with similar dovetailed channels 21 for receiving horizontally disposed sealing elements 18 extending across the full length of each of the barrier elements 14. As will be described in more detail, this provides for effective sealing between each of the barrier elements and its vertically adjacent neighboring barrier element to provide a highly effective, waterproof flood barrier for the door opening 11.

Pursuant to the invention, the individual barrier elements 14 can be extruded of a lightweight material, such as aluminum, with a uniform cross section throughout. The barrier elements are generally of a C-shaped cross section comprised of a generally flat, vertical back wall 22 and upper and lower flange structures 23, 24 extending forwardly from the back wall 22. As a significant feature, the upper and lower flange structures 23, 24 are configured to provide a mutual mechanical pivoting interlock between vertically adjacent barrier elements, to both simplify assembly of a plurality of the barrier elements into a complete barrier structure, and to provide for a stronger and more stable structure during and after the assembly process. To this end, the upper flange structure 23 is comprised of a generally flat, horizontal back portion extending forwardly from the back wall 22 and forming an upwardly facing sealing surface 25, a generally vertical riser 26 extending upwardly from the back portion, and an upper flange portion 27 projecting forwardly from the riser 26. Preferably, the forward extremity of the upper flange portion 27 is rounded, as indicated at 28.

Figure 5B:
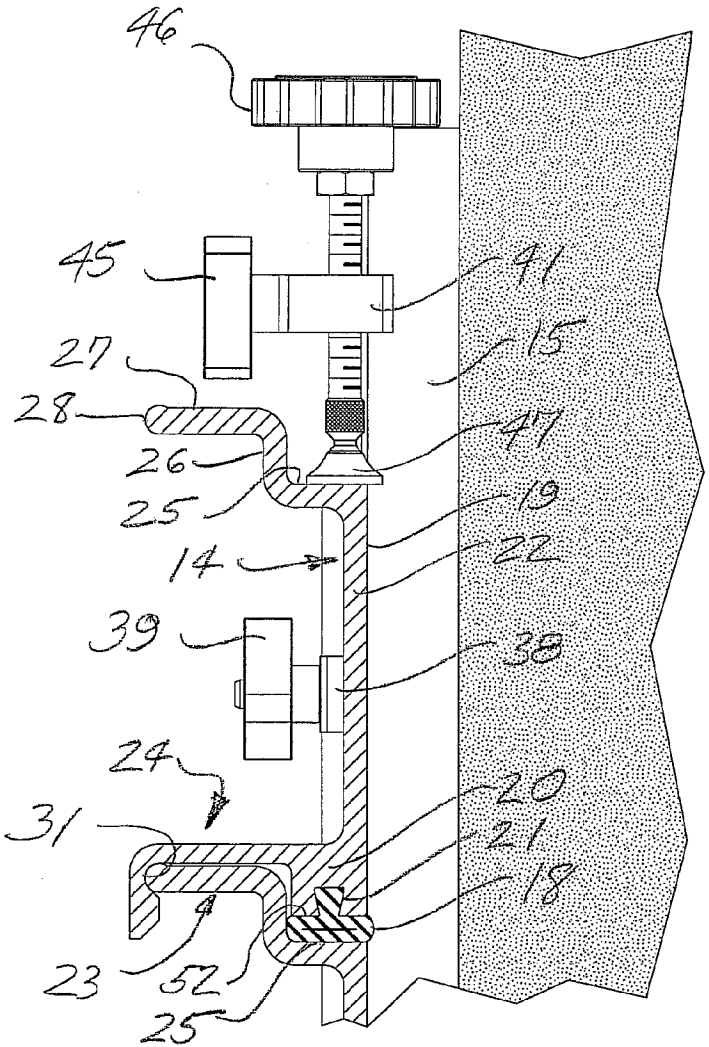
FIG. 5B is a view similar to FIG. 5A, showing the barrier element after being pivoted into installed position and engaged at the top by vertically acting clamping means.
Figure 5A:
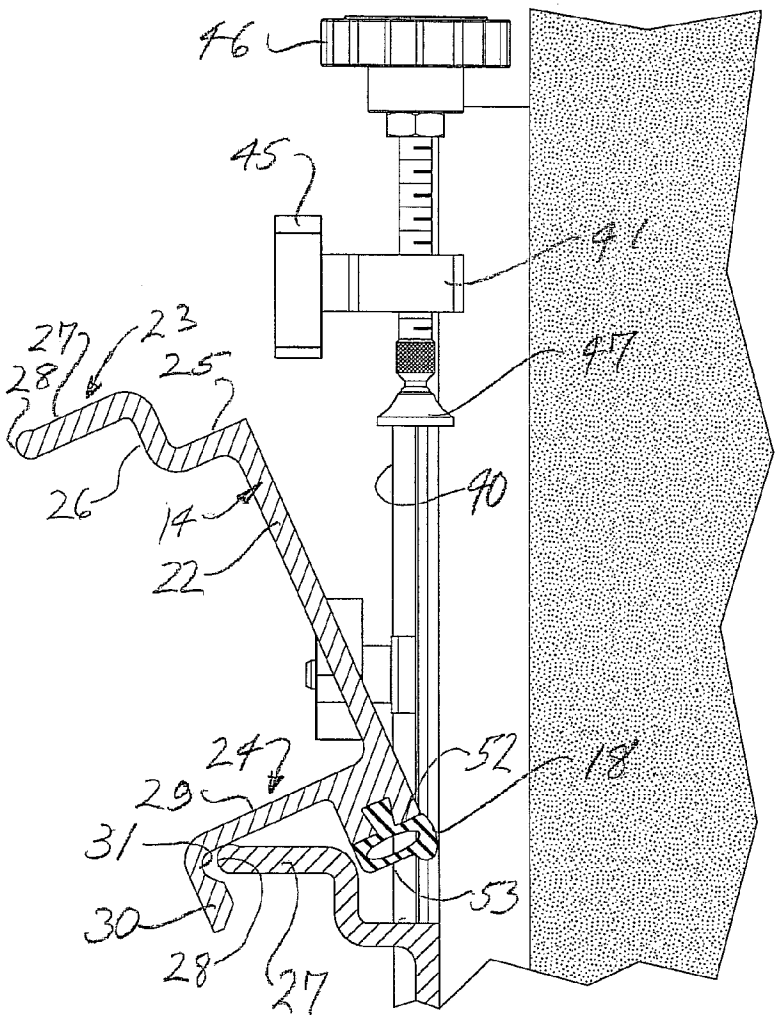
FIG. 5A is an enlarged, fragmentary cross sectional view illustrating the manner in which an interlocking barrier element according to the invention is positioned for installation.

The bottom flange structure 24 of the barrier element is comprised of a horizontally disposed base flange 29, which extends forward from the back wall 22, and a relatively thick, back flange 20, which projects downward from the base flange 29. The back flange 20 includes the previously mentioned dovetailed slot 21 and mounts the sealing element 18. The base flange 29, is joined at its forward end with a vertical flange element 30 which extends downwardly from the base flange 29. As shown in FIGS. 5A and 5B, the inside corner between the lower flange elements 29, 30 is recessed with a concave, generally circular contour to form a socket 31, arranged to receive the rounded forward extremity 28 of the upper flange portion 27 of an adjacent, lower barrier element. The arrangement is such that, when building a barrier structure by assembling individual barrier elements 14 one on top of another, starting at the bottom, a new barrier element can be seated against a previously installed element in the manner shown in FIG. 5A, with the flange edge forward extremity 28 seated in the recessed socket 31 of the new element. The new barrier element is thus properly aligned and supported on the previously installed barrier element while in a forwardly tilted orientation, illustrated in FIG. 5A. When the new barrier element is thus seated, it can be pivoted rearwardly until the bottom surface of its base flange 29 overlies the top surface of the upper flange portion 27 of the adjacent lower barrier element 14. In this position, shown in FIG. 5B, the resilient sealing element 18 is compressed against the sealing surface 25 of the adjacent lower barrier element, to form a tight seal between the two elements. The forward portions of the respective flange structures 23, 24 are interlocked by engagement of the rounded forward end extremity 28 of the lower barrier element with the concave socket 31 of the adjacent higher barrier element, as shown in FIG. 5B, providing significant rigidity to the assembled structure.

Figure 6:
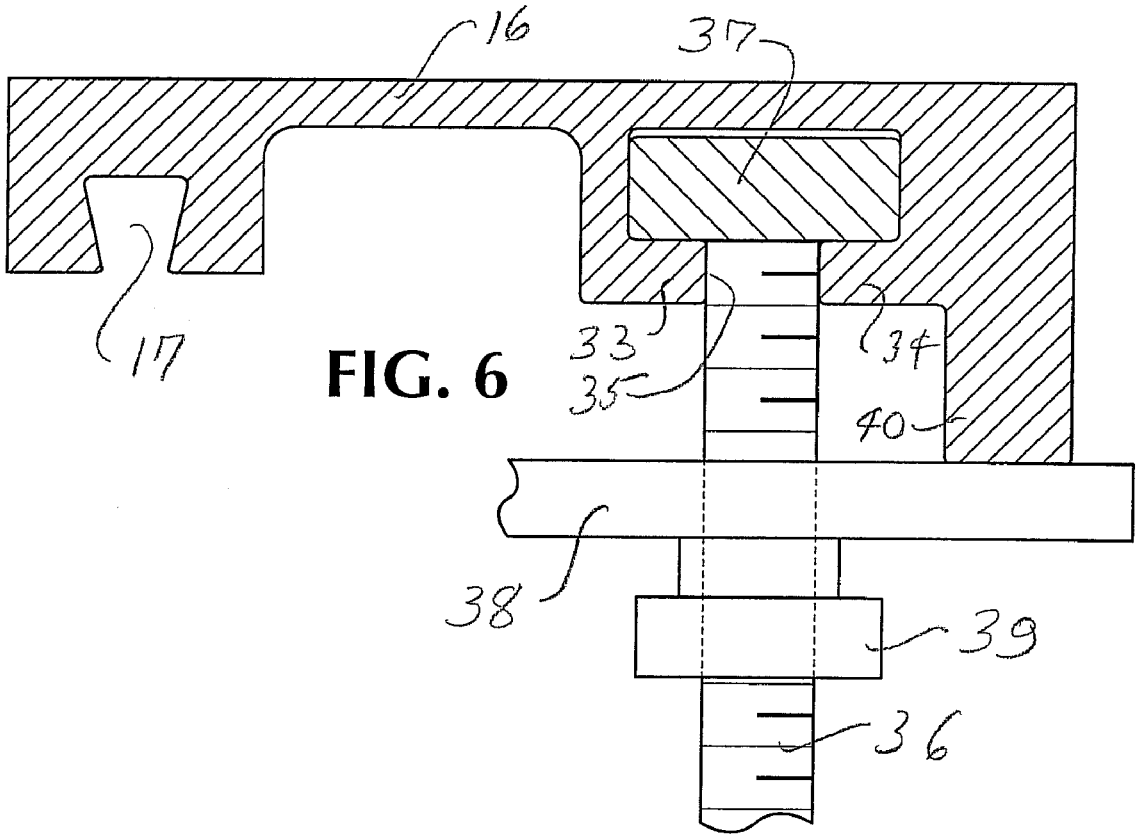
FIG. 6 is an enlarged cross sectional view of a vertical rail element provided at each side of the opening to slideably position the various clamping elements incorporated into the structure.

In the application of Jason W. Smith, individual barrier elements are clamped at their respective opposite ends by clamping elements mounted on side rails, and the entire vertical stack of barrier elements is compressed downwardly by vertically acting clamping elements engaging the uppermost element. That same general arrangement is followed in the structure of the present invention, with certain significant improvements being provided to facilitate and expedite the installation of a flood barrier structure, which often must be done on an emergency basis, and also to facilitate the subsequent dismantling and removal of the structure after a flood threat subsides. To this end, each of the vertical side rails 15, 16 is provided with a vertical channel 32 partially closed by two front flanges 33, 34 (FIG. 6) to form a vertical slot 35. Clamping bolts 36, provided with square bases 37, are slideably but non-rotatably received in the vertical channels 32. Each of the bolts 36 (with the exception of the uppermost one, to be later described) pivotally mounts a clamping bar 38 and a threaded tightening knob 39. The clamping bars 38 are freely pivotable on the bolts 36, and are of sufficient length that, when pivoted into a horizontal position, one end overlies a projecting flange 40 at the outer edge of each of the rails 15, 16, while the other end of the clamping bar overlies an end portion of an adjacent barrier element 14.

Figure 2:
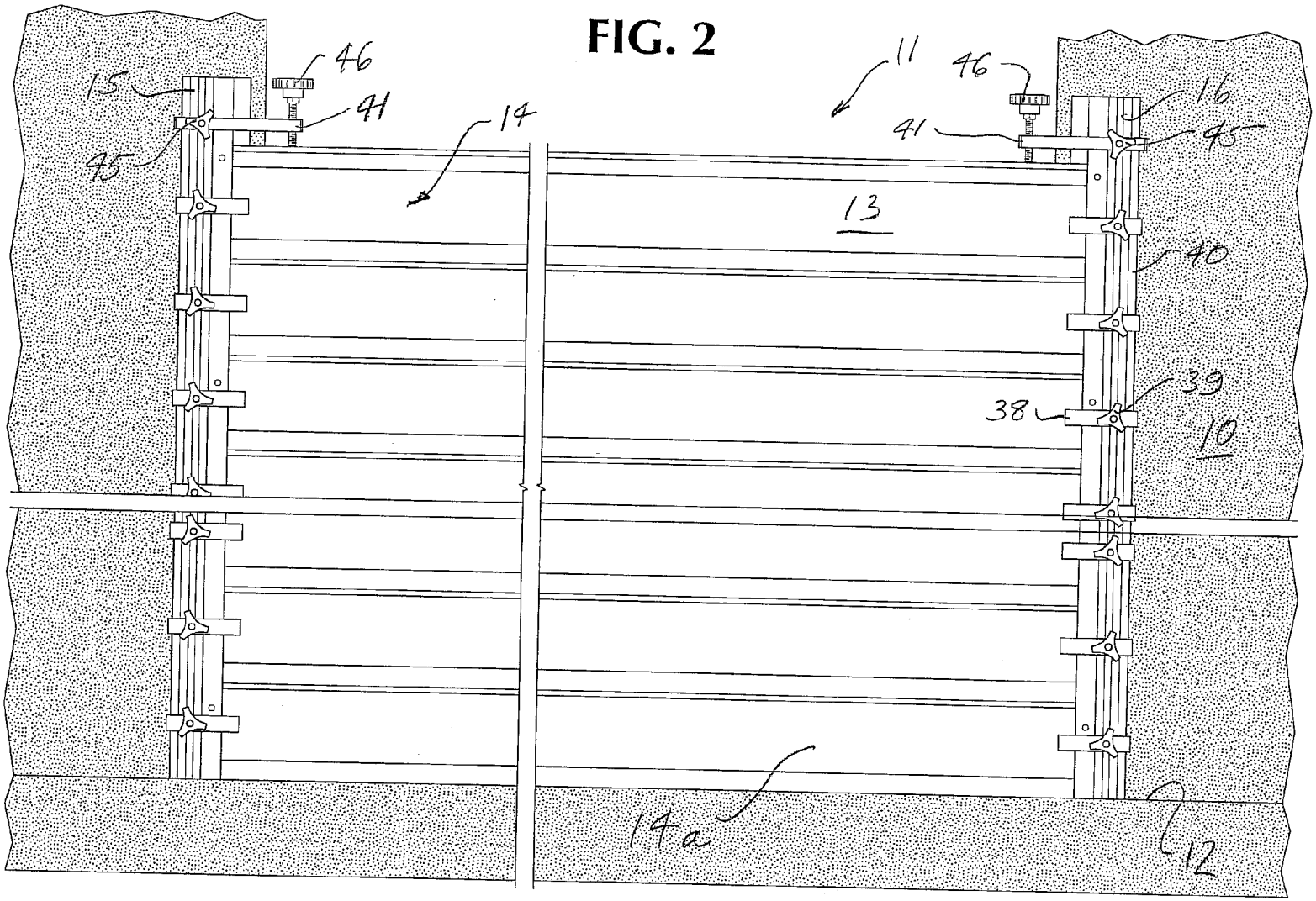
FIG. 2 is a front elevational view of the barrier installation of FIG. 1.

After each barrier element is initially positioned in the structure, a clamping assembly, comprising a bolt 36, clamping bar 38 and tightening knob 39 is inserted into the upper end of the rail channel 32 and slid downward to a position opposite the open end of the recently positioned barrier element. The clamping bar 38 is then pivoted from a vertical position to a horizontal position, with its inner end overlying the end of the barrier element 14, as generally shown in FIG. 2. The clamping bar can then be tightened by means of the knob 39 to press the barrier element against the vertical sealing element extending up the inside edge of the rails 15 or 16. During the initial assembly process, the clamping bars 38 are adjusted to press only lightly against the front of the barrier element, to securely hold it in assembled position, while accommodating subsequent limited downward movement when vertical compression is applied to the entire stack of barrier elements.

After the uppermost barrier element has been installed and lightly clamped, vertically acting clamping assemblies are installed in each of the side rails 15, 16. The vertically acting clamping assemblies, shown best in FIG. 4, comprise a support bar 41 formed along its back side with a contoured recess 42 shaped to fit closely with the configuration of the vertical rails 15, 16 and preferably to overlap the opposite side edges of the rails. A bolt assembly 43 has its base 36 inserted vertically into the rail channel 32 and slid downward to a position slightly above the uppermost barrier element 14. A bolt 44 extends through the support bar 41 and engages a tightening knob 45. This arrangement allows the clamping assembly to be moved to a suitable position above the uppermost barrier element, with the support bar 41 spaced a few inches above the surface 25 of the uppermost barrier element. The knob 45 is then tightened to secure the assembly in position.

Figure 4:
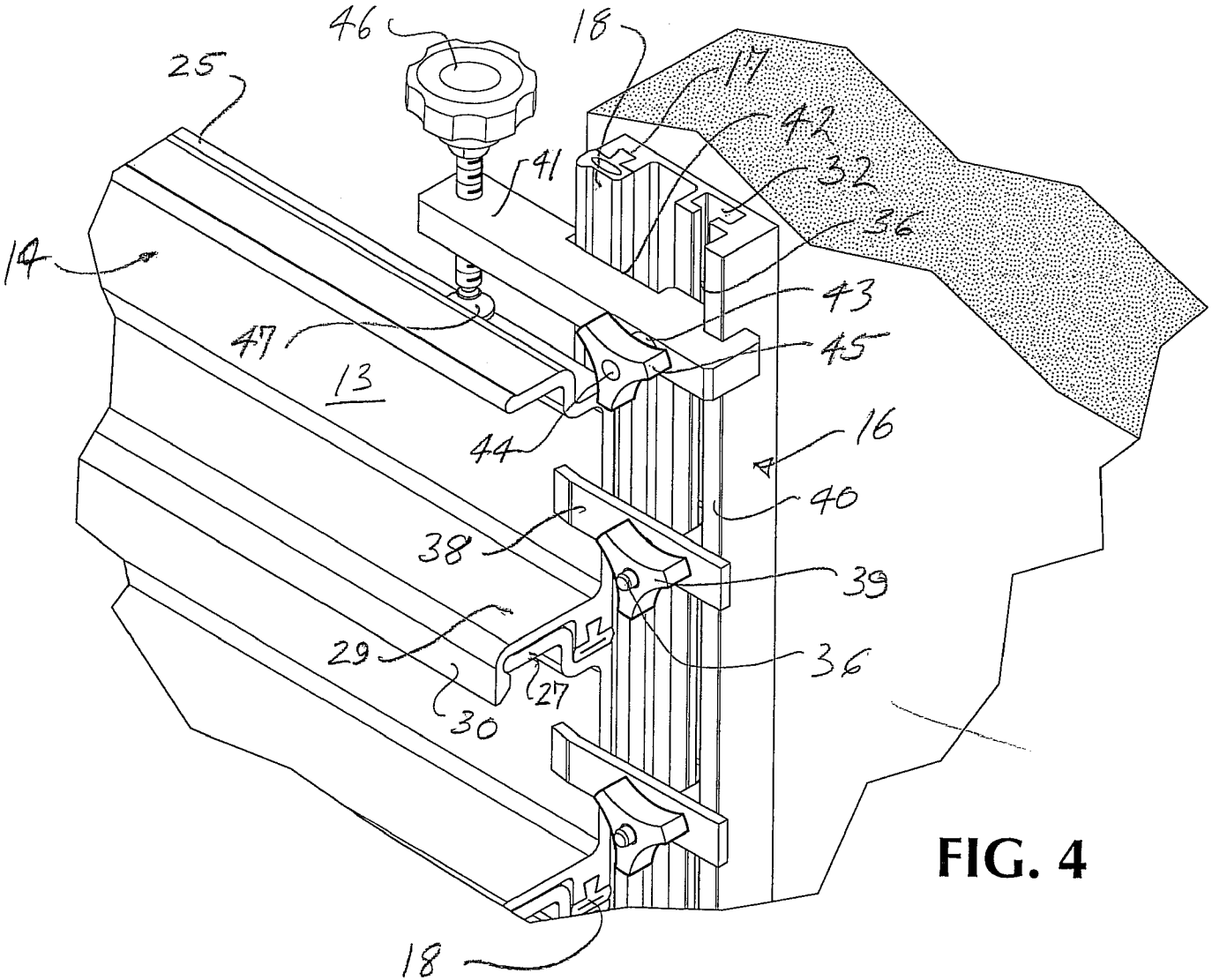
FIG. 4 is an enlarged, fragmentary perspective view illustrating certain details of horizontal and vertical clamping arrangements incorporated in the structure of the invention.

At the inner end of the support bar 41 is a screw clamp 46 which threadedly engages the support bar 41 and has a clamping pad 47 at its lower end engaging the surface 25. When the clamping assembly is positioned as shown in FIG. 4, the threaded screw clamps 46 at each side are tightened, to press downwardly on the uppermost barrier element 14. This applies vertical clamping pressure throughout the entire stack of barrier elements, to assure good sealing between vertically adjacent elements. When vertically acting clamping pressure is applied by tightening of the elements 46, the support bar 41 is prevented from rotating by engagement of the side edges of the recesses 42 with their respective side rails 15, 16. This action also tends to lock the support bar 41 securely in its adjusted position.

After tightening of the vertically acting clamping elements 46, the various horizontal clamping bars 38 are tightened to press the individual barrier elements snugly against the sealing element 18 extending vertically up the front face of each of the rails 15, 16.

To advantage, the sealing elements 18 (FIG. 7) are formed of a high density neoprene closed cell sponge material 48, formed with an outer skin 49 and preferably with an elongated hollow portion 50. Along one side, the sealing element is formed with a deformable projection 51. The described form of sealing element, accommodates significant compression, so that highly effective sealing is assured. Additionally, the outer skin 49 provides resistance to scuffing, which is beneficial given that the barrier elements may be installed, uninstalled and stored numerous times during their working life.

To particular advantage, the lower front flange element 30 of the barrier element 14 projects downwardly from the base flange 29 to a level below the bottom surface 52 of the back flange 20, but above the lower surface 53 (FIG. 5A) of the sealing element 18 mounted in the back flange 20, when the sealing element is in a relaxed state. This configuration allows the lowermost barrier element 14*a* (FIG. 3) to be placed directly on the threshold surface 54. With the flange element 30 resting on the threshold surface 54, and the vertical back wall 22 of the barrier element positioned flat against the side rails 15, 16, the sealing element 18 of the lowermost barrier element 14*a* is tightly compressed against the threshold surface 54. With this arrangement, the lowermost barrier element 14 may in many cases be placed directly on the surface of a flat concrete threshold, avoiding the need for installing a special flat steel threshold, for example.

The flood barrier structure of the present invention has important advantages over known structures. Of particular importance, the interlocking configuration of the individual barrier logs not only expedites the assembly operations required to install a flood barrier, but enables the individual barrier elements to be of a lighter construction. As a result, the individual barrier elements are lighter in weight and easier to handle during installation and removal operations. Additionally, and importantly, the barrier elements are less costly, making the system more attractive in the marketplace.

The barrier structure of the invention significantly facilitates the installation of flood barriers of any desired height, to suit the expected flooding conditions. Moreover, should conditions be expected to worsen, after an initial installation of a partial height barrier, the barrier height may be quickly increased by adding one or more barrier elements to the top of the existing stack. For both installation and removal of the structure, the clamping mechanisms, can be slid into or out of the vertical channels provided. When dismantling the barrier assembly, the clamping facilities are entirely removed from the side rails 15, 16, leaving only relatively plain, low profile side rails, free of projections and the like.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A flood barrier system for sealing an opening in a wall structure against the inflow of flood waters which comprises:

(a) a plurality of elongated barrier elements of a length greater than a width of the opening, (b) said barrier elements having front and back sides and being oriented horizontally and stacked vertically one upon the other with their back sides facing an outer face of the wall structure to form a flood barrier, (c) said barrier elements being positioned with opposite end portions thereof overlapping outer surfaces of the wall structure laterally adjacent opposite sides of the opening, (d) a horizontal support surface supporting a lowermost one of said barrier elements and extending for the width of said opening, (e) horizontally acting clamping elements engaging the end portions of said barrier elements for retaining back surface portions of said end portions in a sealing relationship with the outer surfaces of the wall structure overlapped thereby, (f) vertically acting pressure clamps mounted on the wall structure and positioned above an uppermost one of said barrier elements to bear downwardly upon said uppermost barrier element and thereby upon the entire plurality of stacked barrier elements to provide a seal between vertically adjacent barrier elements and between said lowermost barrier element and the support surface, (g) said barrier elements being formed with mutually interlocking top and bottom flange structures joined by a vertically oriented back wall whereby top portions of first barrier elements are mechanically interlocked in a front-to-back direction with bottom portions of second barrier elements positioned directly above and supported on said first barrier elements, (h) the bottom flange structure of each of said barrier elements comprising a base flange extending forwardly from said back wall and spaced apart front and back downwardly projecting portions joined with said base flange, and the top flange structure of said barrier elements comprising a generally flat, horizontally disposed back portion forming an upwardly facing sealing surface, a riser extending upward from a forward edge of said sealing surface, and an upper flange portion extending forwardly from an upper portion of said riser and engageable with the front downwardly projecting portion of the bottom flange structure of a second barrier elements positioned immediately above to interconnect with and form a pivot for said second barrier elements, (i) vertical rails mounted in sealed relation to the front face of said wall structure adjacent to side edges of the opening therein, (j) said rails being formed with first and second vertical channels therein positioned adjacent inside and outside side edges respectively of said rails, (k) vertical sealing strips received in said first vertical channels and extending from bottom extremities of said rails to a level equal or higher than a maximum height of a barrier system to be constructed, (l) said second vertical channels being formed with front flanges extending from opposite sides of the channels toward the centers thereof and defining a restricted channel openings, and (m) a plurality of bolt bases slideably and non-rotatably received in said second vertical channels, each with a threaded bolt extending forwardly through the restricted channel openings, (n) said horizontally acting clamping elements including clamping bars received on said bolts and tightening nuts received on said bolts in front of said clamping bars, (o) said bolts and bolt bases being slideable vertically in said second vertical channels to position the clamping bars thereon opposite the end portions of said barrier elements, (p) said clamping bars being rotatable on the bolts such that the clamping bars may be pivoted into a position with one end bearing on a front-facing surface of an adjacent a barrier element and an opposite end bearing on a front facing surface of a vertical rail, whereby said adjacent barrier element may be forcibly compressed against the sealing element in said rail.

2. The flood barrier system according to claim 1, wherein said vertically oriented back wall has a flat back surface engageable with the vertical sealing elements on said vertical rails and a front surface engageable at opposite ends by said clamping bars.

3. The flood barrier system according to claim 1, wherein (a) a pair of uppermost clamping bars are positioned on said bolts and said bolt bases in uppermost portions of said second vertical channels, (b) said uppermost clamping bars cooperate with said vertical rails to restrain rotation of said uppermost clamping bars about the bolts on which they are positioned, (c) inner portions of said uppermost clamping bars extend over the tops of an uppermost one of said barrier elements, and (d) each of said uppermost clamping bars includes a vertically acting pressure clamp adjustable to bear downward on said uppermost barrier element to apply vertical pressure to a stack of barrier elements forming a flood barrier.

4. The flood barrier system according to claim 3, wherein, (a) said uppermost clamping bars, along with said bolts and said bolt bases, are vertically movable in said second vertical channels to positions closely overlying the uppermost barrier element in a stack thereof, and (b) said uppermost clamping bars are at least partially self-locking in any vertically adjusted positions on said vertical rails upon the application of vertically acting pressure to said uppermost barrier element.

* * * * *